United States Patent [19]

Ostrem

[11] 4,018,357

[45] Apr. 19, 1977

[54] POUR OPENING FOR LIQUID CONTAINERS

[75] Inventor: Obert M. Ostrem, Westmont, Ill.

[73] Assignee: The Continental Group, Inc., New York, N.Y.

[22] Filed: Aug. 9, 1976

[21] Appl. No.: 712,621

[52] U.S. Cl. ..... 220/268; 220/277; 222/81; 222/541

[51] Int. Cl.² ..... B65D 41/32

[58] Field of Search ..... 220/267–273, 220/277; 222/81–83, 541

[56] References Cited

UNITED STATES PATENTS

| | | | |
|---|---|---|---|
| 3,730,379 | 5/1973 | Brown | 220/269 |
| R27,518 | 10/1972 | Brown | 220/269 |

*Primary Examiner*—George T. Hall

*Attorney, Agent, or Firm*—Paul J. Lerner; Joseph E. Kerwin; John J. Kowalik

[57] ABSTRACT

An improved easy-opening end closure wherein the end panel is formed with a number of intersecting, straight score lines which define a number of interconnected non-detachable openable segments adapted to be pushed inwardly to open the closure. An opening member is provided, adapted to effect opening of the closure pursuant to a panelwardly directed application of digital pressure on the nose portion thereof, and having a number of camming surfaces for fracturing the score lines and for urging the segments inwardly.

4 Claims, 13 Drawing Figures

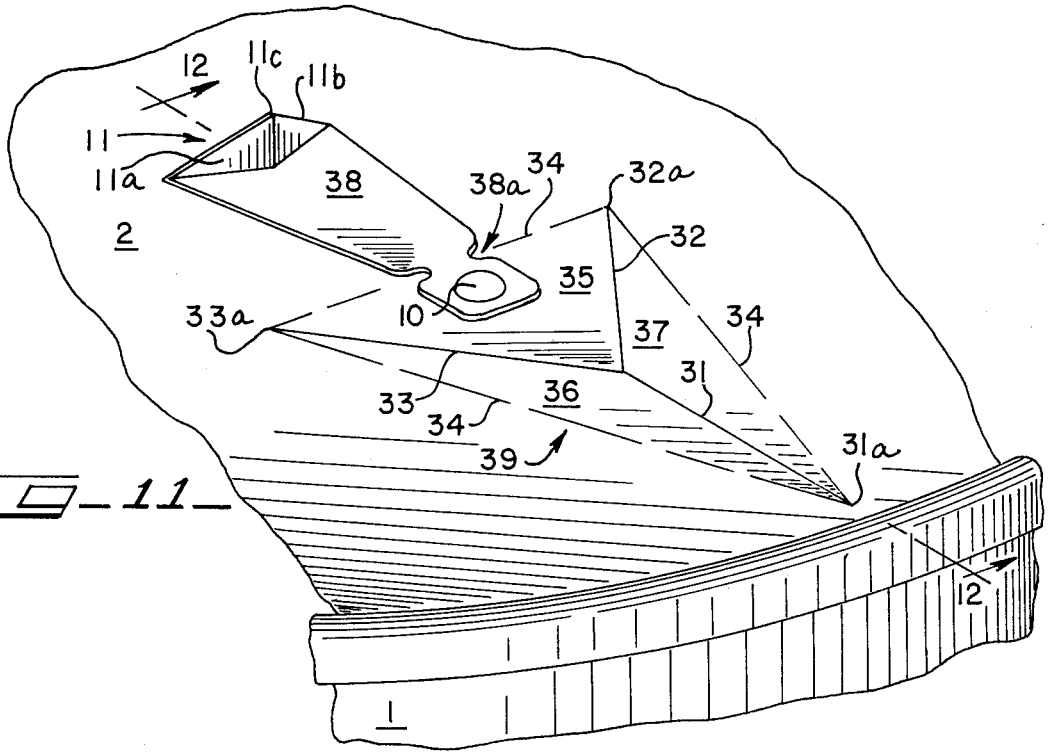
FIG. 11
FIG. 12
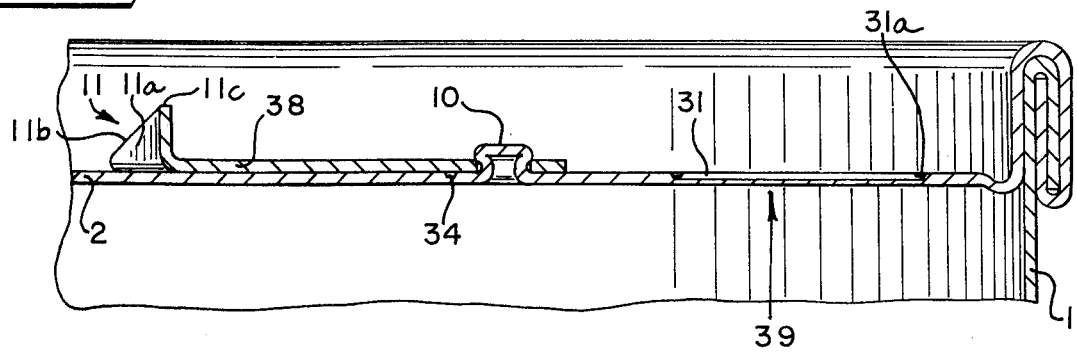
FIG. 13
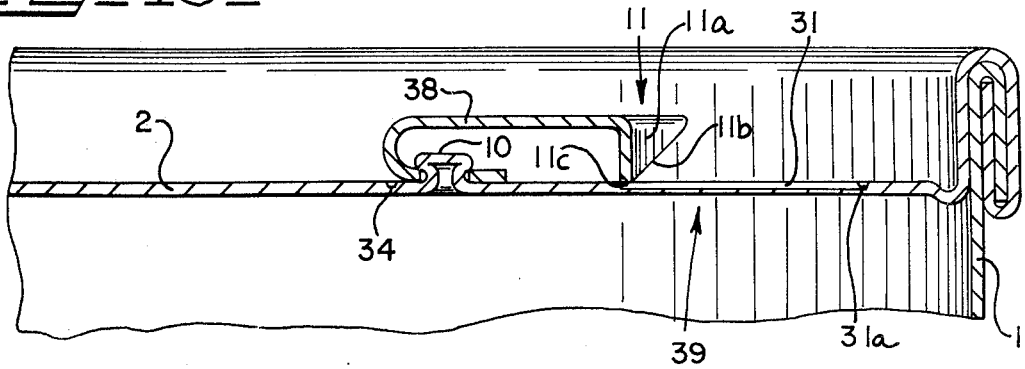

POUR OPENING FOR LIQUID CONTAINERS

SUMMARY OF THE INVENTION

The present invention relates to containers and the like and is particularly concerned with containers having easy-open closure means.

The usual easy-opening container has a flap or tear strip formed in a container wall. A tab is secured directly to the flap and upon lifting of the tab, the flap is completely severed from the container wall to form an opening therein. The tab and flap are relatively small and are frequently carelessly discarded followng their removal from the container. The container may also be discarded when empty; however, because the container is relatively large, it can be easily collected for disposal. On the other hand, the tabs and flaps, being quite small, are often ignored or overlooked causing a litter problem. The magnitude of this problem is increasing due to the constantly increasing usage of easy-opening containers.

The litter created by the tabs and flaps creates an especially acute problem at recreational areas such as parks and beaches, particularly because conventional devices for picking up litter do not pick up the tabs and flaps. As a result, they continue to accumulate. For this reason, ordinances have been enacted in some areas to bar easy-opening containers where the tab and flap separate from the container body.

Various closures have been developed having nondetachable flaps and tabs as, for example, Re. Pat. No. 27,518. However, such closures generally suffer in that the tab obstructs the pour area after opening of the closure.

It is, therefore, the primary object of the present invention to provide an improved easy-open closure which reduces litter by retaining the tab and flap attached to the container after opening.

It is a further object to provide a nondetachable end closure wherein the pour area is unobstructed after opening of the closure.

It is aother object to provide an improved easy-open closure which may be opened with a minimum of effort.

It is still another object to provide an improved nondetachable easy-open closure having child-resistant characteristics.

BRIEF DESCRIPTION OF THE DRAWINGS

With the above and other objects in view that will hereinafter appear, the nature of the invention will be more clearly understood by reference to the followng description when viewed in light of the accompanying drawings, in which:

FIG. 11 is a perspective view of still another embodiment of the end closure of the present invention.

FIG. 12 is a fragmentary cross-sectional view taken substantially along plane 12—12 of FIG. 11.

FIG. 13 is a fragmentary cross-sectional view similar to FIG. 12, illustrating relocation of the opening member prior to opening of the closure.

DESCRIPTION OF THE PREFERRED EMBODIMENTS

Figure 1:
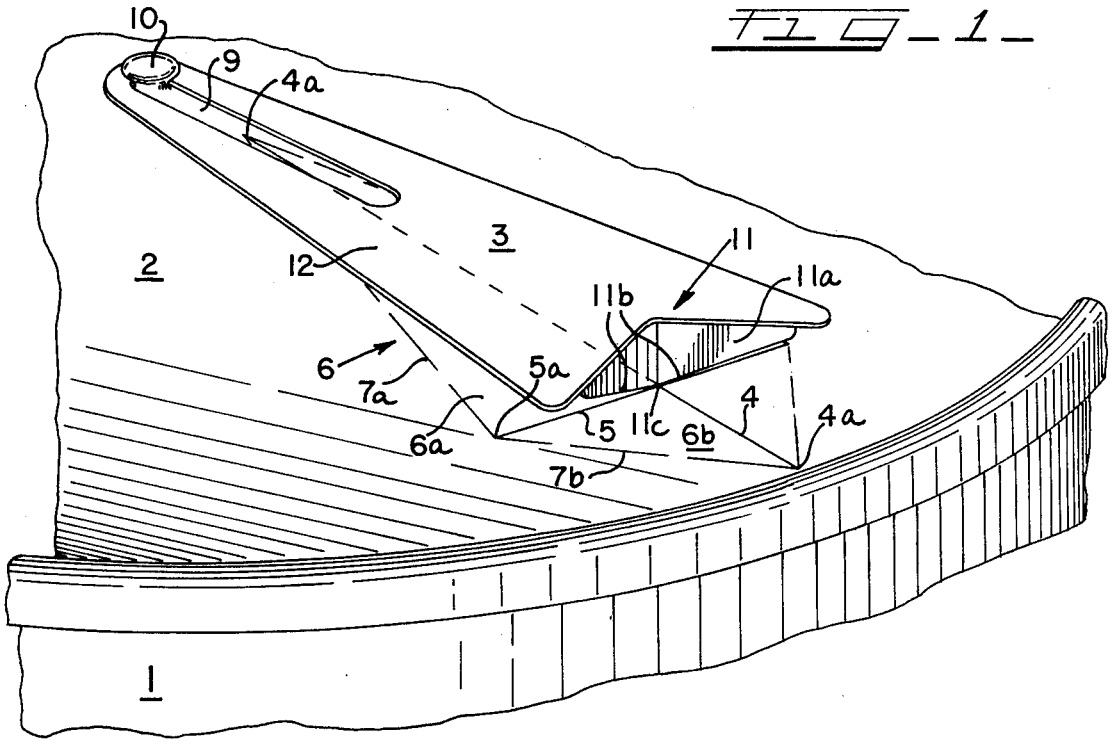
FIG. 1 is a perspective view of one embodiment of the end closure of the present invention.
Figure 2:
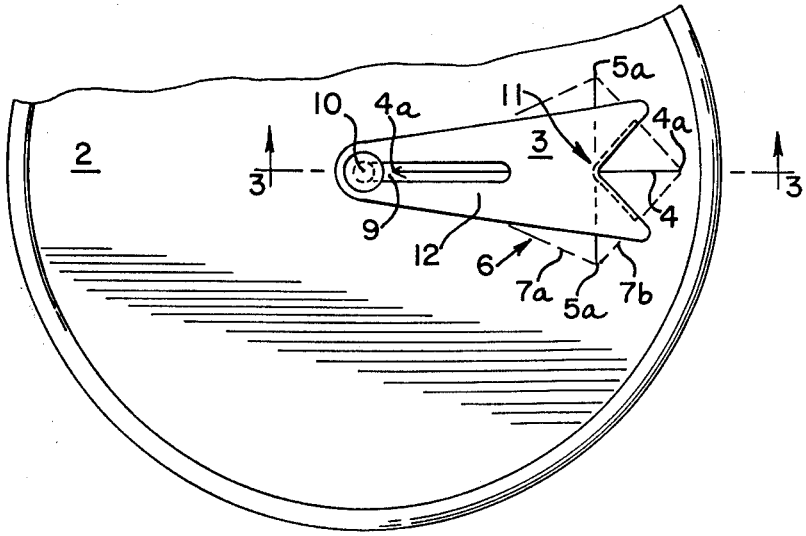
FIG. 2 is a fragmentary top plan view of the embodiment of FIG. 1.

Turning to the drawings, wherein like numerals denote similar parts, there is shown, in FIG. 1, a can body 1, having in association therewith an embodiment of the end closure of the present invention, comprising an end panel 2 and an opening member 3.

Opening score lines 4 and 5 are formed in the end panel 2, arranged in a cross-shaped configuration, with score line 4 lying along a radius of the end panel 2 and bisecting transverse score line 5. The distal ends 4*a* and 5*a* of the opening score lines 4 and 5 define the apices of an openable member 6 composed of interconnected segments 6*a* and 6*b*. The openable member 6 may be further defined by fold score lines 7*a* and 7*b* connecting the ends 4*a* and 5*a* of the opening score lines 4 and 5. A force concentrating member 11 is formed on one end of the opening member 3 and comprises two planar members 11*a*, substantially perpendicular to the plane of the end panel 2, arranged to form an outwardly opening V. The lower edges 11*b* of the planar members 11*a* are inclined relative to the plane of the end panel 2, coming to a point 11*c* at the line of intersectionn of the members 11*a*.

Figure 3:
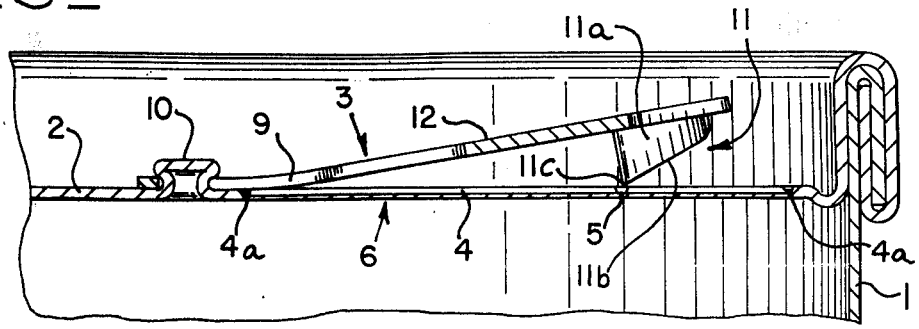
FIG. 3 is a cross-sectional view taken substantially along plane 2—2 of FIG. 1.

An axially elongated slot 9 is formed in the opening member 3 at the end thereof opposite the force concentrating member 11. A rivet 10 passes through the slot 9, slidably, but nonremovably, attaching the opening member 3 to the end panel 2 in a position overlying the openable member 6. As best seen in FIGS. 1 and 3, the opening member body 12 is of a length such that the force concentrating member 11 is proximate the intersection of the two opening score lines 4 and 5 when the rivet 10 abuts the remote end of the slot 9.

Figure 4:
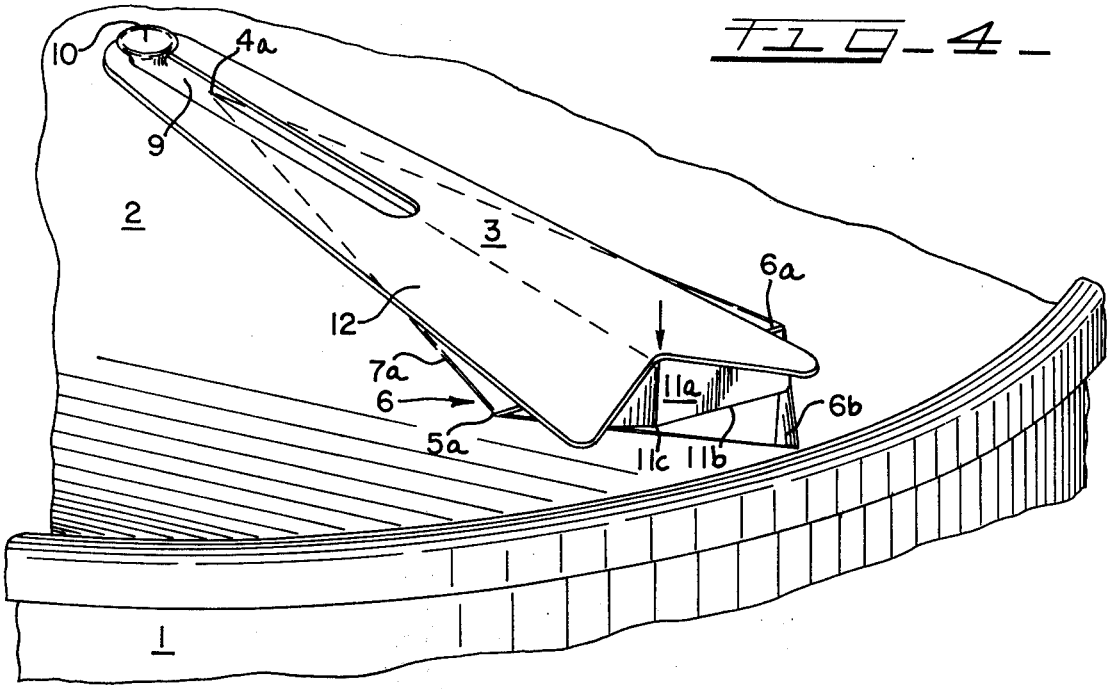
FIG. 4 is a perspective view similar to FIG. 1, illustrating the closure in a partially opened condition.

To open the closure, the distal end of the opening member 3 is forced panelwardly, initially resulting in rupture of the portions of the opening score lines 4 and 5 proximate the intersection thereof. As the opening member 3 is further depressed, the lower edges 11*b* of the outwardly angled planar members 11*a* provide a camming action causing further tearing along the score lines 4 and 5, and urging the segments 6*b* into the can body 1 about the bend score lines 7*b* as best seen in FIG. 4.

Figure 5:
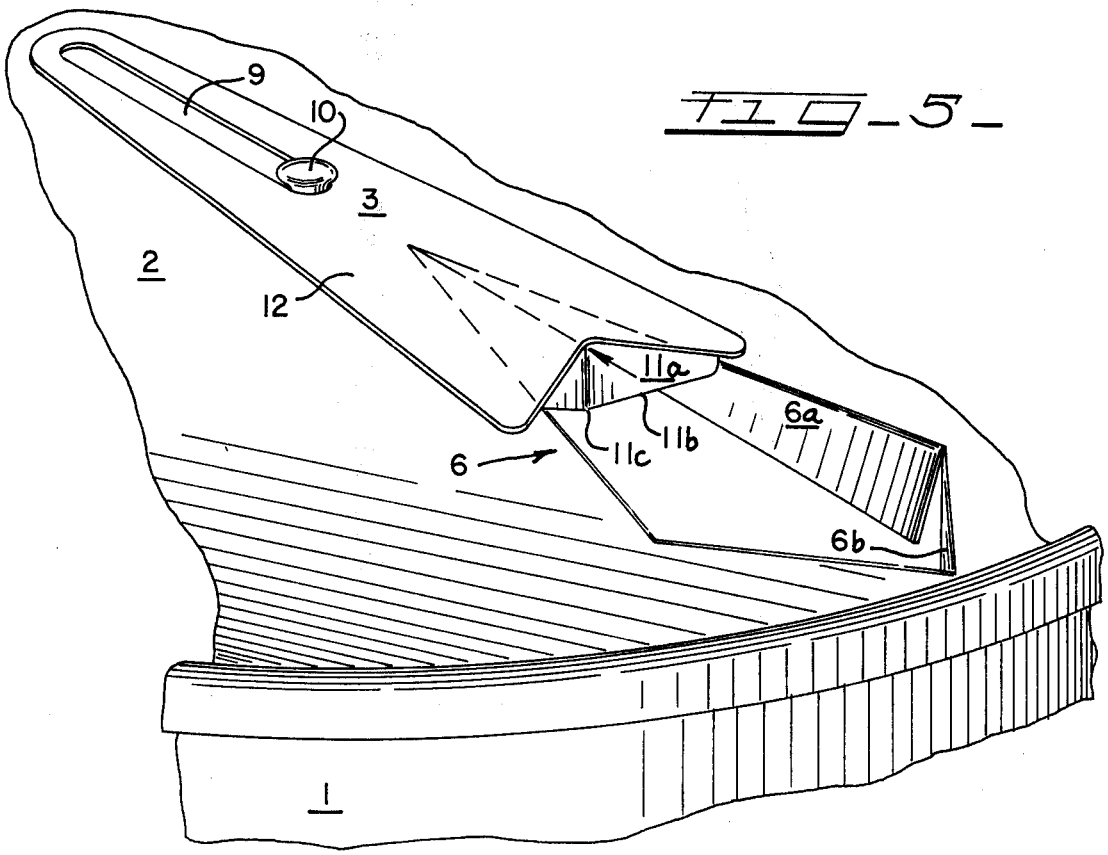
FIG. 5 is a perspective view similar to FIG. 4, illustrating the closure in a fully opened condition.

After the opening member 3 has been fully depressed, i.e. the opening member body 12 is substantially parallel to the plane of the end panel 2, the opening member 3 is displaced radially of the end panel 2, until the rivet 10 abuts the inboard end of the slot 9. This may be accomplished by application of finger pressure to the outer vertical surfaces of the planar members 11*a*. As a result of this displacement, the intact portion of the opening score line 4 is ruptured and the segments 6*a* are bent about fold score lines 7*a* and urged into the can body 1 under the camming action of the panel members 11*a* as seen in FIG. 5. At this point the closure is fully opened. It is to be noted that the opening member 3 is in a nonobstructing position relative to the openable member 6, and that the segments 6*a* and 6*b* remain solidly attached to the end panel 2.

Figure 6:
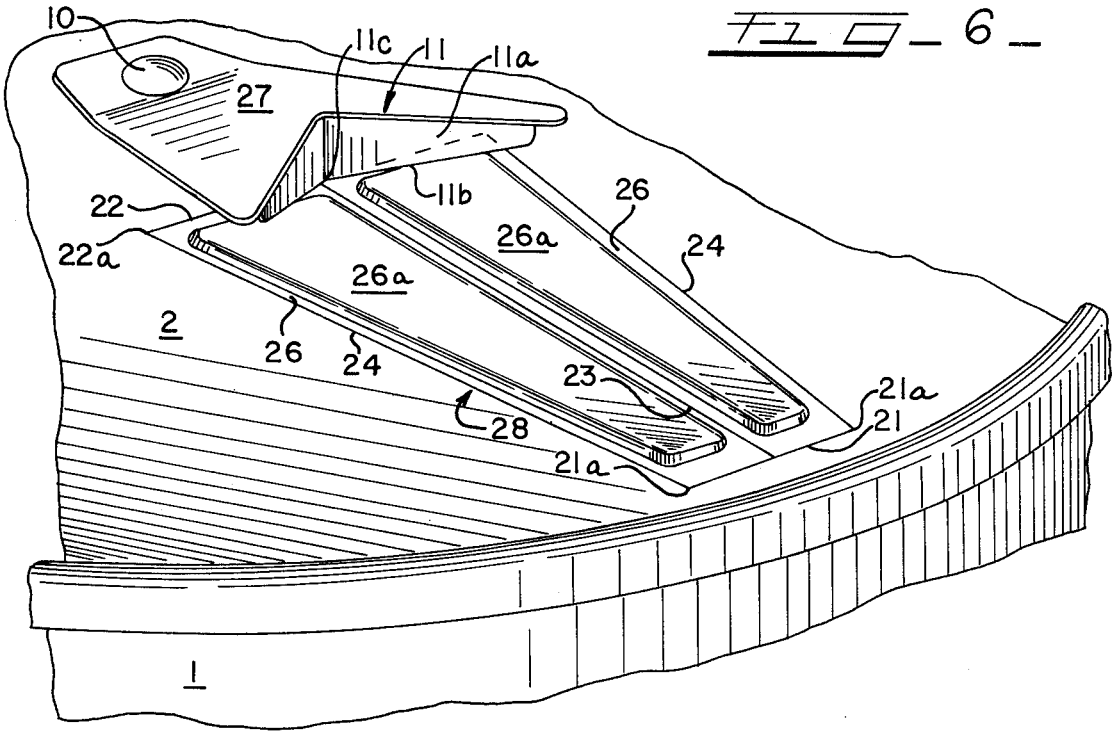
FIG. 6 is a perspective view of another embodiment of the end closure of the present invention.
Figure 7:
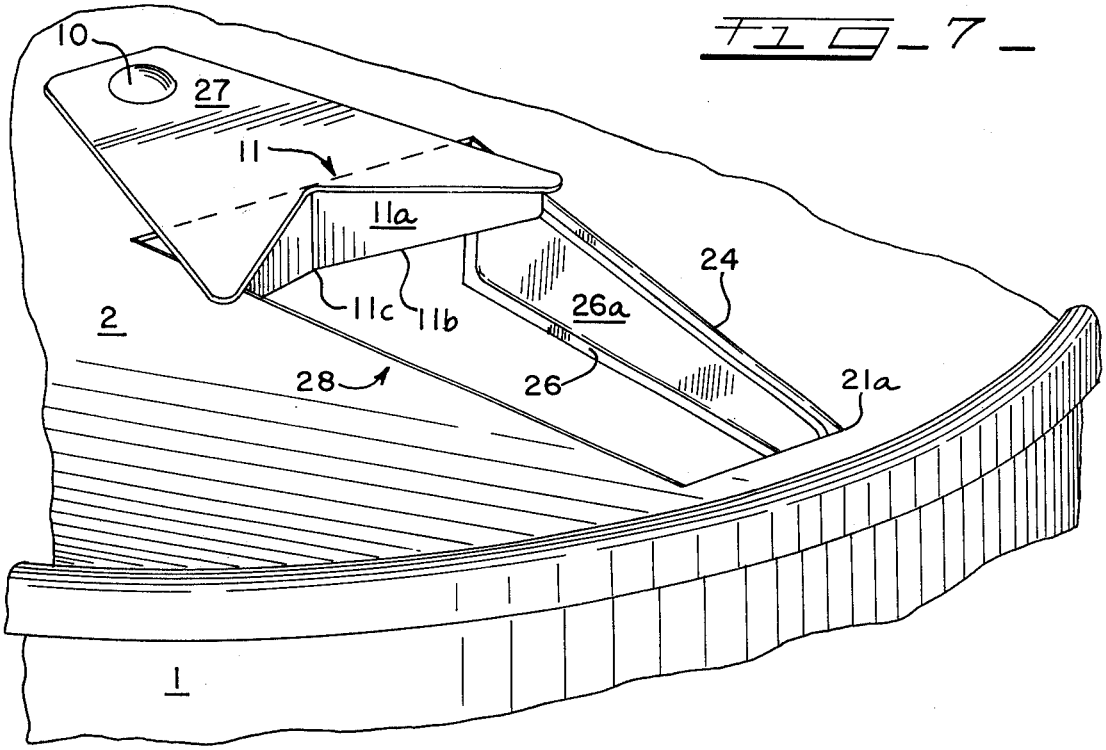
FIG. 7 is a perspective view similar to FIG. 6, illustrating the closure in an opened condition.

As shown in FIGS. 6 and 7, an alternate embodiment of the present invention is contemplated, having transverse opening score lines 21 and 22 connected by a radial opening score line 23. The ends 21*a* and 22*a* of the score lines 21 and 22 are joined by fold score lines 24, defining thereby two connected trapezoidal segments 26 having raised portions 26*a* formed therein and comprising an openable member 28.

Opening member 27, nonremovably attached to the end panel 2 by rivet 10, overlies the openable member 28, with the force concentrating member 11 centered above the radial opening score line 23.

Opening of this embodiment of the closure is accomplished by panelwardly displacing the distal end portion of the opening member 27, causing rupture of the radial opening score line 23 and bring the angled lower edges 11*b* of the planar members 11*a* into contact with the upper surfaces of the raised portions 26*a* of the segments 26. Continued displacement of the opening member 27 results in further, controlled tearing along the radial opening score line 23 and along the transverse opening score lines 21 and 22 as the segments 26 are bent about fold score lines 24 and into the can body 1 under the canning action of the force concentrating member 11.

Figure 8:
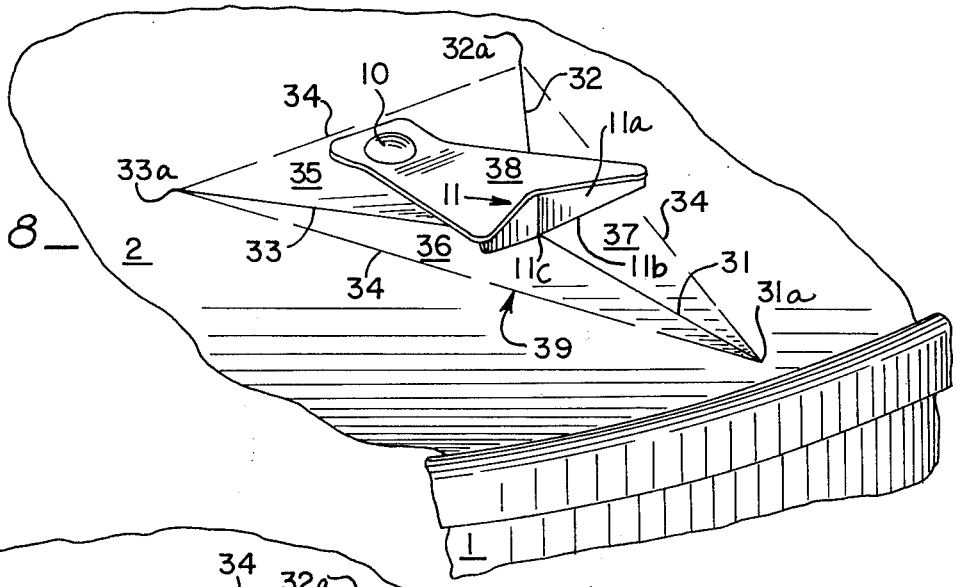
FIG. 8 is a perspective view of yet another embodiment of the end closure of the present invention.
Figure 9:
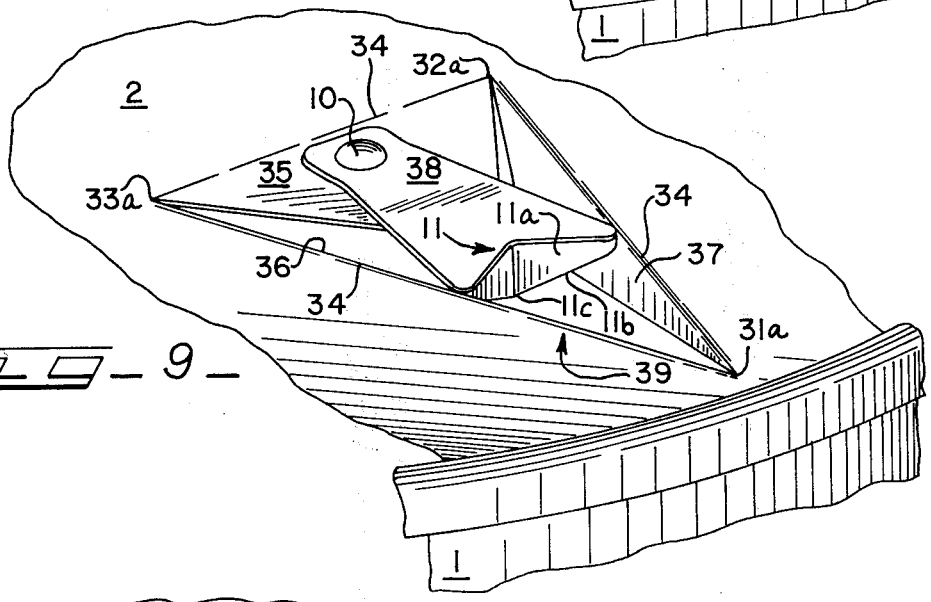
FIG. 9 is a perspective view similar to FIG. 8, illustrating the closure in a partially opened condition.
Figure 10:
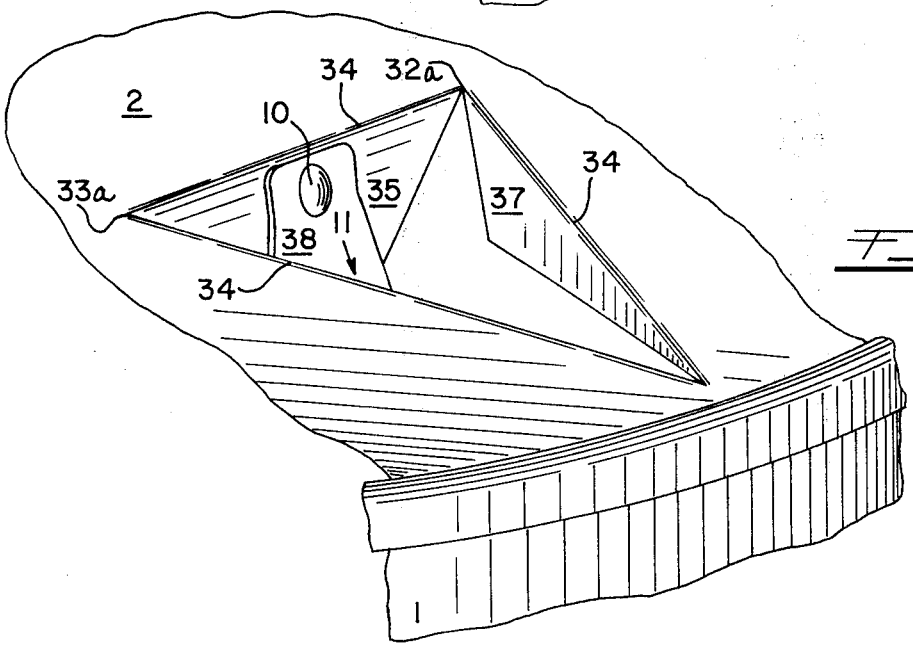
FIG. 10 is a perspective view similar to FIG. 9, illustrating the closure in a fully opened condition.

A further alternate embodiment is illustrated in FIGS. 8 through 10, wherein three intersecting opening score lines 31, 32 and 33 are formed in the end panel 2, arranged in a Y, with score line 31 being radially orientated, and score lines 32 and 33 being symmetrically arranged relative thereto. The distal ends 31*a*, 32*a* and 33*a* of the opening score lines 31, 32 and 33 are connected by fold score lines 34, defining thereby three interconnected triangular segments 35, 36 and 37 comprising an openable member 39.

Opening member 38, nonremovably attached to segment 35 by rivet 10, overlies the openable member 39 with the force concentrating member 11 centered proximately above the intersection of the opening score lines 31, 32 and 33.

Opening of this embodiment of the end closure of the present invention is accomplished substantially in the manner described hereinbefore with regards the previously described embodiments. Specifically, panelward pressure is applied to the distal end portion of the opening member 38, causing rupture and controlled tearing of the opening score lines 31, 32 and 33 and displacement of the segments 35, 36, and 37 into the can body 1 under the camming influence of the force concentrating member 11.

A variant of the embodiment of FIGS. 8 through 10 is shown in FIGS. 11 through 13. In this embodiment, the opening member 38 in an inverted position extending away from the openable member 39, with the force concentrating member 11 pointing upwardly away from the end panel 2.

To open the closure, the opening member 38 is lifted away from the end panel 2, and folded about transverse fold line 38*a* to bring the force concentrating member 11 into position, as shownn in FIG. 13, centered proximately above the intersection of the opening score lines 31, 32 and 33. The distal end portion of the opening member 38 is thereupon panelwardly displaced as hereinabove described. The required extra step required to open this embodiment of the closure, i.e. folding of the opening member 38, is not readily apparent to a young child, and hence comprises a child-resistance feature.

While the preferred arrangements of parts have been shown in illustrating the invention, it is to be clearly understood that various changes in details may be made without departing from the scope and spirit of the claims appended hereto.

I claim:

1. An improved easy-opening end closure for a can or similar container, comprising an end panel and an opening member, said end panel having a plurality of substantially straight, interconnected score lines formed therein, the distal ends of said score lines defining the apices of a substantially rectilinear openable member comprising a plurality of substantially rectilinear segments each having at least two sides thereof defined by said score lines and a side comprising an integral hinge nonremovably attaching said segments to the remaining portion of said end panel, means nonremovably attaching said opening member proximate one end thereof to said end panel, said opening member being adapted to effect opening of said openable member pursuant to a panelwardly directed application of digital pressure on the opening member distal end, said opening member distal end including force concentration means for focusing an initial opening force proximate at least one of said score lines and a plurality of camming surfaces adapted to separate said segments and urge the same into the container subsequent to initial fracture of said one of said score lines, said opening member being attached to one of said segments.

2. The invention according to claim 1, wherein said opening member is foldable about a portion thereof to bring said force concentration means to an opening position proximately overlying at least one of said score lines.

3. The invention according to claim 1, and offset portions formed in said segments and adapted for cooperation with said camming surfaces.

4. The invention according to claim 1, wherein said segments are substantially triangular.

* * * * *